US005299388A

United States Patent [19]

Bishop

[11] Patent Number: 5,299,388

[45] Date of Patent: Apr. 5, 1994

[54] MACHINE FOR USE IN THE MANUFACTURE OF VEHICLE POWER STEERING GEARS

[75] Inventor: Arthur E. Bishop, Sydney, Australia

[73] Assignee: A. E. Bishop & Associates Pty. Limited, North Ryde, Australia

[21] Appl. No.: 50,328

[22] PCT Filed: Oct. 28, 1991

[86] PCT No.: PCT/AU91/00494

§ 371 Date: May 19, 1993

§ 102(e) Date: May 19, 1993

[87] PCT Pub. No.: WO92/10333

PCT Pub. Date: Jun. 25, 1992

[30] Foreign Application Priority Data

Dec. 10, 1990 [AU] Australia ..... PK3787

[51] Int. Cl.[5] ..... B24B 19/02; B24B 5/36

[52] U.S. Cl. ..... 51/97 R; 51/105 VG; 51/289 R

[58] Field of Search ..... 51/97 R, 94 R, 94 CS, 51/105 VG, 289 R, 327, 105 SP

[56] References Cited

U.S. PATENT DOCUMENTS 730,445 6/1903 Echols ..... 51/94 CS
1,252,509 1/1918 Thomas ..... 51/289 R

FOREIGN PATENT DOCUMENTS 0212452 9/1988 Japan ..... 51/105 VG
4-069149 3/1992 Japan ..... 51/105 VG

*Primary Examiner*—Robert A. Rose
*Attorney, Agent, or Firm*—Nikaido, Marmelstein, Murray & Oram

[57] ABSTRACT

A machine for grinding the outer metering edge contours (26) on the edges of the axially extending grooves (18) of a power steering gear input-shaft (10) in which a substantially cylindrical grinding wheel (40) whose working surface is dressed parallel to the axis of the input-shaft (10) effects the grinding, the distance between the input-shaft (10) and the grinding wheel (40) being cyclically increased and decreased several times during each revolution of the input-shaft (10) in such a manner that each outer metering edge contour (26) so ground has a form which is a mirror image of the form of at least one other outer metering edge contour (26) around the outside periphery of the input-shaft (10), characterized in that the angular velocity of the input-shaft (10) is varied cyclically in a manner co-ordinated with the cyclic increase and decrease of the distance between the input-shaft (10) and the grinding wheel (40) thereby substantially reducing the peak rate of stock removal per unit time compared with the peak rate that would occur if the angular velocity were constant and equal to the mean value of the cyclically varying angular velocity.

4 Claims, 8 Drawing Sheets

MACHINE FOR USE IN THE MANUFACTURE OF VEHICLE POWER STEERING GEARS

Figure 1:
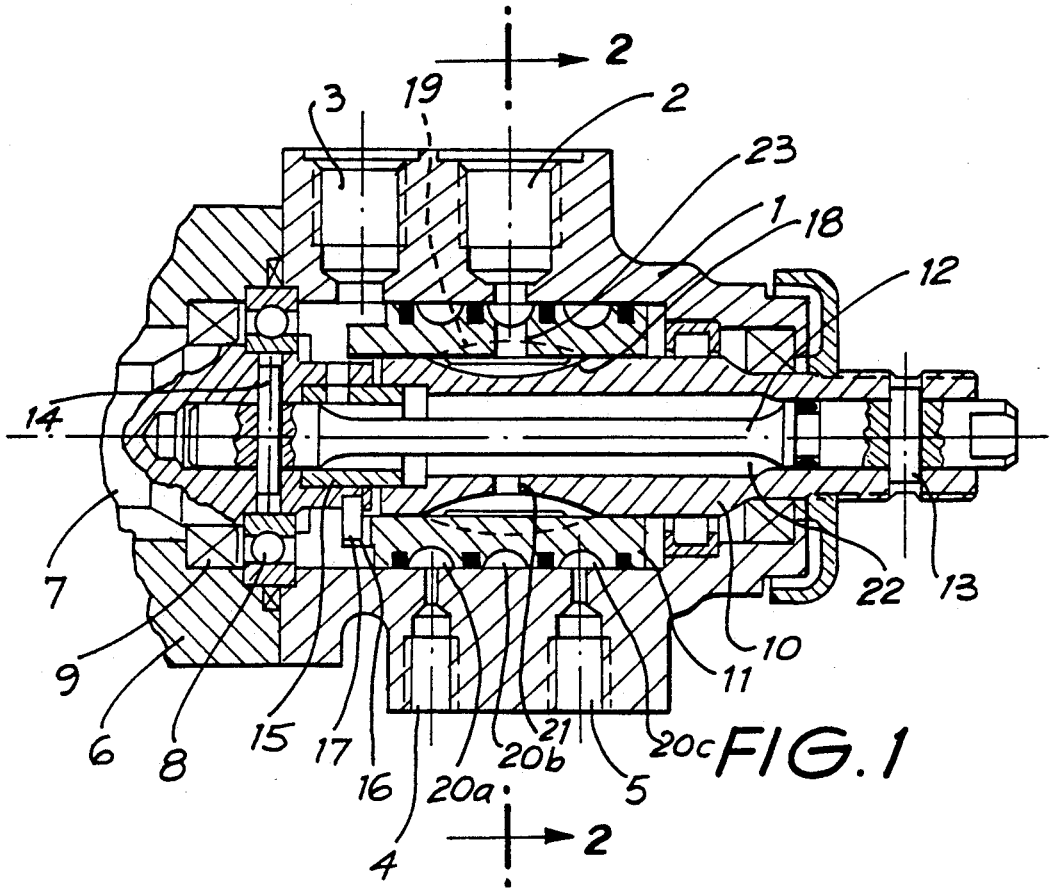

This invention relates to a method and apparatus for manufacturing fluid control contours in components of rotary valves such as used in hydraulic power steering gears for vehicles. Such rotary valves include an input-shaft which incorporates in its outer periphery a plurality of blind-ended, axially extending grooves separated by lands. Journalled on the input-shaft is a sleeve having in its bore an array of axially extending blind-ended slots matching the grooves in the input-shaft, but in underlap relationship thereto, the slots of the one being wider than the lands of the other so defining a set of axially extending orifices which open and close when relative rotation occurs between the input-shaft and the sleeve from the centred or neutral condition, the magnitude of such rotation henceforth referred to as the valve operating angle. The edges of the input-shaft grooves are contoured so as to provide a specific orifice configuration often referred to as metering. These orifices are ported as a network such that they form sets of hydraulic Wheatstone bridges which act in parallel to communicate oil between the grooves in the input-shaft and the slots in the sleeve, and hence between an engine driven oil pump, and right-hand and left-hand hydraulic assist cylinder chambers incorporated in the steering gear, thereby determining the valve pressure characteristic.

The general method of operation of such rotary valves is well known in the art of power steering design and so will not be described in any greater detail in this specification. A description of this operation is contained in U.S. Pat. No. 3,022,772 (Zeigler), commonly held as being the "original" patent disclosing the rotary valve concept.

Such rotary valves are nowadays regularly incorporated in firewall-mounted rack and pinion steering gears and, in this situation, any noises such as hiss emanating from the valve are very apparent to the driver. Hiss results from cavitation of the hydraulic oil as it flows in the orifices defined by the input-shaft metering edge contours and the adjacent edges of the sleeve slots, particularly during times of high pressure operation of the valve such as during vehicle parking manoeuvres. It is well known in the art of power steering valves that an orifice is less prone to cavitation if the metering edge contour has a high aspect ratio of width to depth, thereby constraining the oil to flow as a thin sheet of constant depth all along any one metering edge contour. Similarly it is important that the flow of oil divides equally amongst the aforementioned network of orifices, so further effectively increasing the above aspect ratio. This requires highly accurate angular spacing of the input-shaft metering edge contours as well as the precision of manufacture of each metering edge contour to ensure uniformity of depth along their length. Precision is most important in that portion of the metering edge contour controlling high pressure operation of the rotary valve associated with parking manoeuvres, where the pressure generated is typically 8 MPa and the metering edge contour depth only about 0.012 mm. This portion lies immediately adjacent to the outside diameter of the input-shaft, and is associated with the maximum normal operating angle of the valve. However, precision is also required in order to avoid hiss further down the metering edge contour where the pressure generated is typically 2 MPa and the contour depth about 0.024 mm. The remainder of the metering edge contour towards the centred position of the rotary valve is important in determining the valve pressure characteristic, but not valve noise.

It is also well known that cavitation is less likely to occur if the metering edge contour is of a wedge configuration having a slope of no more than about 1 in 12 with respect to the outside diameter of the input-shaft. The low slope of the metering edge contour in the parking region makes it difficult to achieve the above-mentioned highly accurate angular spacing of the metering edge contours, which latter spacing controls valve operating angle and hence, not only valve noise, but also the steering gear parking efforts.

Figure 7:
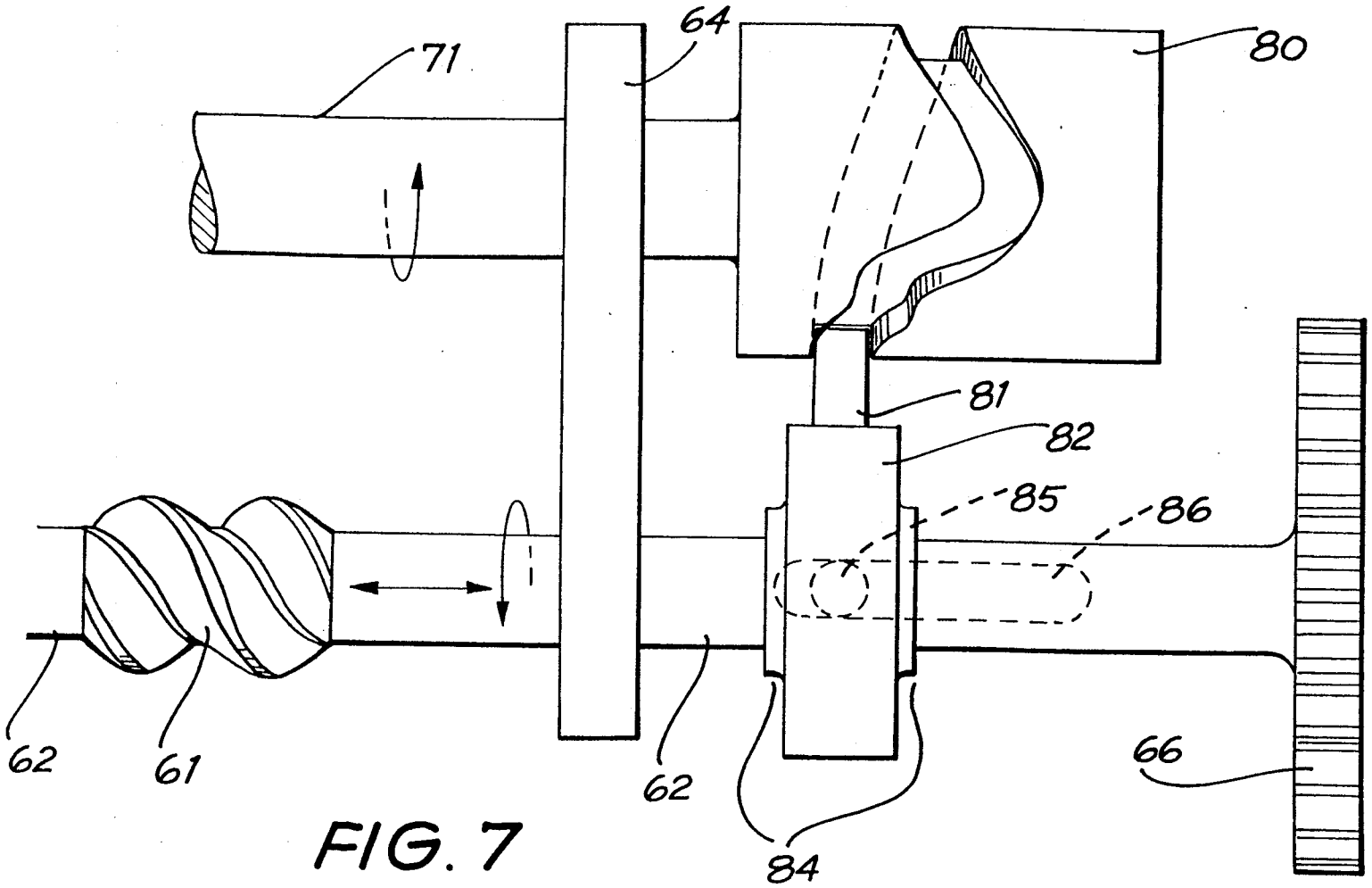

Several manufacturers seek to achieve the above described accuracy by grinding metering edge contours in special purpose chamfer grinding machines in which the input-shaft is supported on centers previously used for cylindrically finish grinding its outside diameter. Such machines have a large diameter grinding wheel, of a width equal to the axial extent of the metering edge contours, which is successively traversed across the edge of each input-shaft groove thereby producing a series of flat chamfers. In some cases each metering edge contour is constructed from more than one chamfer. For example U.S. Pat. No. 4,460,016 (Haga), recommends that three gently sloping chamfers be used on each edge in order to reduce flow separation and hence cavitation and noise. However such an input-shaft design, if employing six slots, requires as many as 36 separate traverses of the cylindrical grinding wheel to manufacture the metering edge contours, with the input-shaft necessarily being indexed between each traverse. An eight slot version of the input-shaft would require 48 separate traverses and indexes. Such a manufacturing method is therefore time consuming and expensive with all metering edge contours frequently requiring over two minutes to be processed. Furthermore the use of this process can result in a valve pressure characteristic which has undesirable re-entrancies as shown in FIG. 7 of U.S. Pat. No. 4,460,016 (Haga), due to the fact that the contours do not constitute a smooth curve.

In such chamfer grinding machines the large diameter grinding wheel makes it impossible to grind that part of the metering edge contour disposed towards the centerline of the groove where increasing depth would cause the grinding wheel to interfere with the opposite edge of the same groove. This steeply sloping and relatively deep portion of the input-shaft metering edge contour will henceforth be referred to as the "inner" metering edge contour and its geometry generally affects the on-center region of the valve pressure characteristic. This portion is generally manufactured by means other than the chamfer grinding machines just described which, for reasons stated, are only capable of grinding the "outer" metering edge contour. This previously described gently sloping wedge shaped portion of the metering edge contour determines the valve pressure characteristic at medium and high operating pressures, as well as determining the valve noise characteristic.

According to the invention the outer metering edge contours are ground during continuous rotation of the input-shaft, thus providing faster grinding of the contours compared with the prior art grinding methods without any sacrifice of depth or index accuracy. Metering edge contours may be ground which include chamfers, arcs, scrolls, and other convex contours, or indeed any arbitrary combination thereof.

Now, cam grinding machines are well known in machining practice and are used extensively for the grinding of such components as cam shafts for automobile engines, thread cutting taps and router cutters. In such cam grinding machines, the workpiece is supported on centers and rotated continuously while being cyclically moved towards and away from a grinding wheel under the action of a master cam. The master cam is directly gear driven by, and therefore synchronized with, rotation of the workpiece. The required amount of stock is progressively removed by infeeding of the grinding wheel during many revolutions of the workpiece. However several features of the grinding of rotary valve input-shaft metering edge contours according to the invention are unique and call for special measures which are not exampled in the machines designed for these other applications.

In accordance with the present invention, the outer metering edge contours are not roughed out first, but rather are ground directly on the grooved cylindrical input-shaft blank in typically one or two revolutions thereof. This means that for equal increments of the rotation of the input-shaft, the amount of stock removal varies enormously several times during each revolution of the input-shaft. In a typical case, the peak rate of stock removal per unit angle of rotation is 20 or 30 times as great as the mean rate. However, practical considerations dictate that the rate of stock removal per unit time must not exceed some low value if the surface of the grinding wheel, necessarily for this purpose composed of very fine grit and of a specific bonding material, is not to be degraded by such sudden peak rates of stock removal. As is well known, if the rate of stock removal in a grinding operation is either too fast or too slow, then the proper rate of wheel breakdown will not occur leading either to glazing of the grit or excessive rate of breakdown of the bonding material.

In the present invention this limitation is overcome by varying the angular velocity of the input-shaft during each revolution by a similar large ratio, in a manner as nearly as possible the inverse of the aforementioned rate of stock removal per unit angle of workpiece rotation. The actual stock removal rate per unit time will therefore vary through a much lesser range than would have occurred had the angular velocity been uniform. The time taken to grind a complete set of metering edge contours is thereby reduced to only a small fraction of the time required by conventional methods, and the time between dressings of the wheel is greatly increased.

The present invention therefore consists of a machine for grinding the outer metering edge contours on the edges of the axially extending grooves of a power steering gear input-shaft having means for supporting said input-shaft for rotation, a substantially cylindrical grinding wheel whose working surface is dressed parallel to the axis of said input-shaft, drive means to rotate said input-shaft, means to cyclically increase and decrease the distance between said input-shaft and said grinding wheel several times during each revolution of said input-shaft in such a manner that each said outer metering edge contour so ground has a form which is a mirror image of the form of at least one other outer metering edge contour around the outside periphery of said input-shaft, so defining symmetrical sets of clockwise and anticlockwise metering edge contours, characterized in that said drive means is arranged to vary cyclically the angular velocity of said input-shaft in a manner co-ordinated with said cyclic increase and decrease of said distance between said input-shaft and said grinding wheel, thereby substantially reducing the peak rate of stock removal per unit time compared with the peak rate that would occur if said angular velocity were constant and equal to the mean value of said cyclically varying angular velocity.

In most cases, when the peak rate of stock removal per unit angle of rotation is occurring, the input-shaft will substantially stop rotating for several milliseconds while the input-shaft is moved towards the grinding wheel. Thus, to merely vary the angular velocity of the master cam of a prior art cam grinding machine would be unsatisfactory due to the earlier described direct synchronism between rotation of the master cam and rotation of the workpiece of such machines. Thus, during such times when the workpiece has almost stopped rotating, the effective infeed rate of the grinding wheel with respect to the workpiece also necessarily drops to near zero. To achieve a satisfactory level of machine productivity, two separate variable speed drives would have to be used for input-shaft rotation and infeed functions, and such drives would have to be held in perfect synchronism over a very large range of angular velocity of the input-shaft. Such a requirement would be difficult to achieve, even if two numerically controlled servo motors were employed for the drives of such cam grinding machines.

According to a preferred form of the present invention, a single motor drives two cams. The first cam drives infeed/outfeed functions and is analogous to the master cam in prior art cam grinding machines. The second cam drives a differential device which, according to its profile, cyclically varies the velocity ratio between the motor and the rotating input-shaft. This differential device facilitates a large cyclic variation in the angular velocity of the input-shaft, without affecting the infeed/outfeed function provided by the first cam. Moreover since both cams are directly driven by a single motor and therefore perfectly synchronized, so are the infeed/outfeed and rotational motions of the input-shaft. The large velocity ratio variation made possible by the differential device also enables a practical profile to be employed on the infeed/outfeed cam, without cusps or regions of excessively low radius.

It is important to note that the stock to be removed during the grinding of a metering edge not only varies per unit angle of rotation, but is also completely different when a metering edge contour of given form is being ground towards the adjacent groove as compared to when a metering edge contour of identical form is being ground away from this groove. Therefore, even though opposed metering edge contours may be of symmetrical form with respect to the groove centerline, the required input-shaft angular velocity variation to maintain an approximately constant rate of stock removal per unit time will have an asymmetrical characteristic with respect to such a centerline.

Some manufacturers employ input-shafts in which the metering edge contours on opposing sides of the grooves are of quite different form however, in such cases, a contour on any one edge, say in a clockwise direction, will be the mirror image of another, anticlockwise edge around the shaft so defining mirror-image sets of metering edge contours and so preserving the necessary symmetry of operation of the valve. The number of grooves in such input-shafts must be divisible by 4, typically either 8 or 12 grooves. In such cases the angular velocity of the input-shaft, when grinding opposing edges, will be further modified in the appropriate manner.

In general it follows that a specific pattern of variation in angular velocity will be required for each design of input-shaft and its specific metering edge contours. It is preferred that the edges be ground in one or two revolutions of the input-shaft. If many revolutions of gradually increasing depth were used, during the initial revolutions only the tip of the contour adjacent to the pre-machined groove edge would be touched by the grinding wheel, and hence a very long time would be taken to grind the entire outer metering edge contour. The very rapid changes to the angular velocity required when grinding in only one or two revolutions pose great difficulties for the drive mechanism to the input-shaft, whether mechanically or controlled by NC, which difficulties are overcome by a machine constructed according to the present invention.

Figure 2:
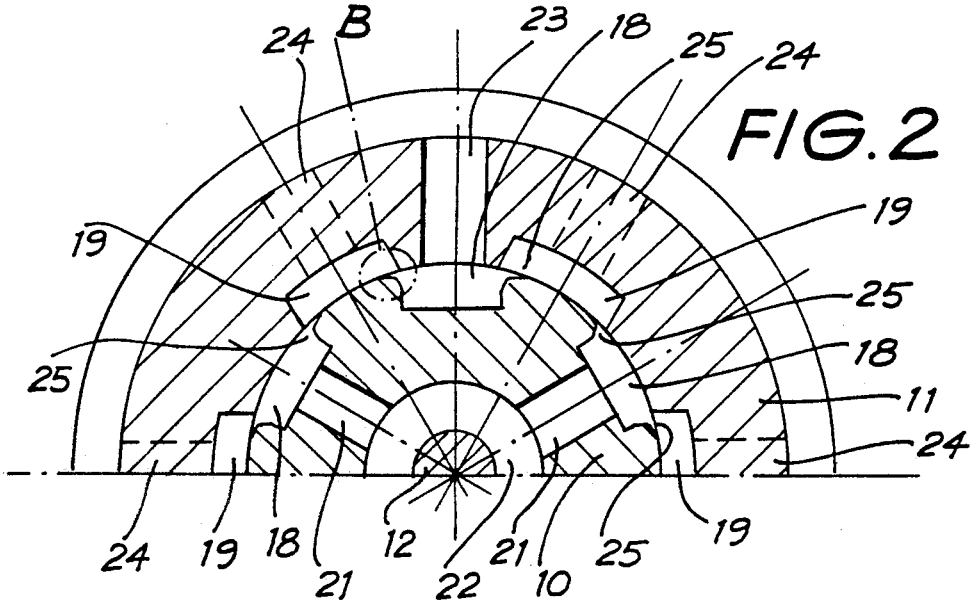
Figure 3:
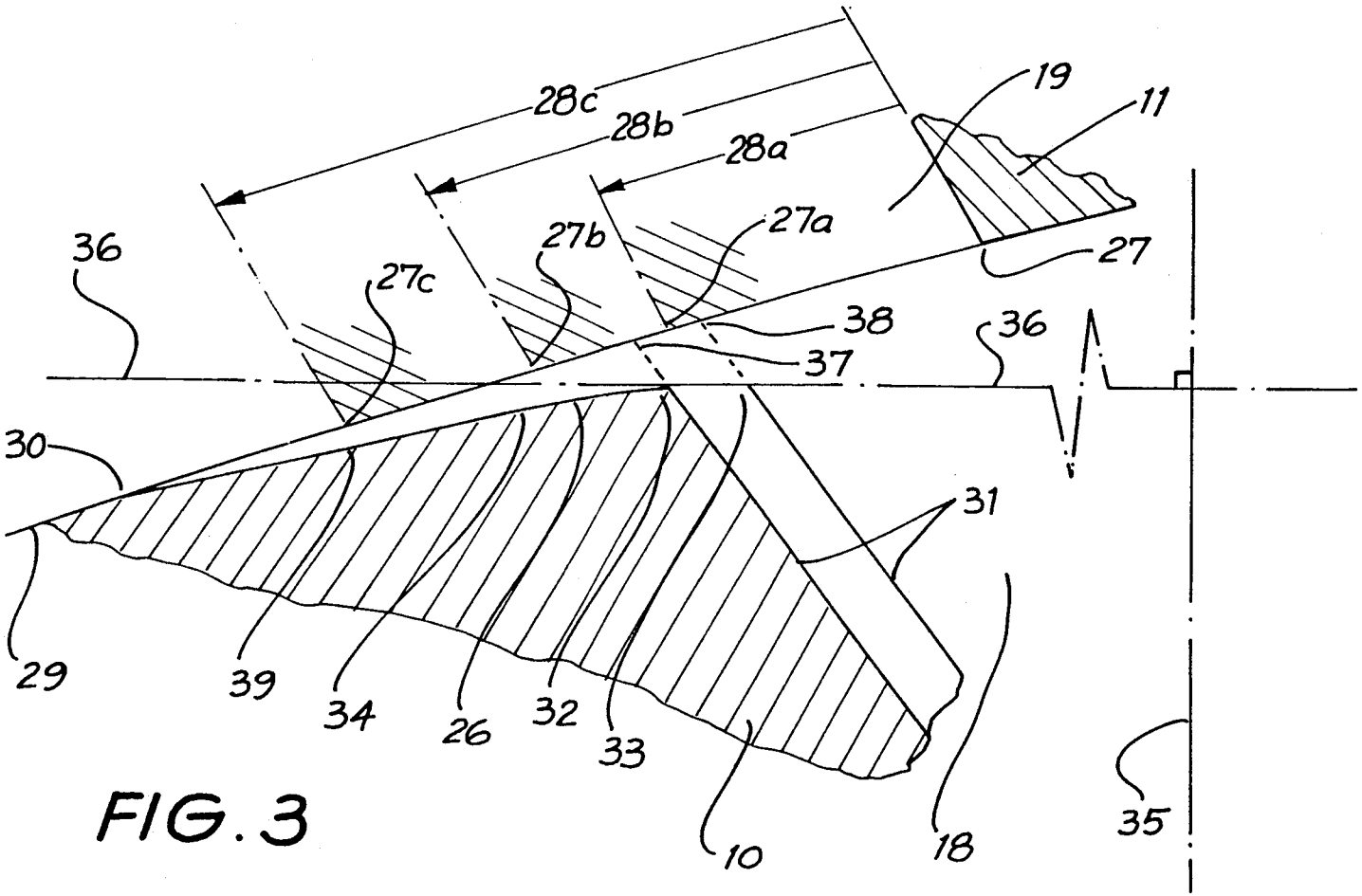
Figure 4:
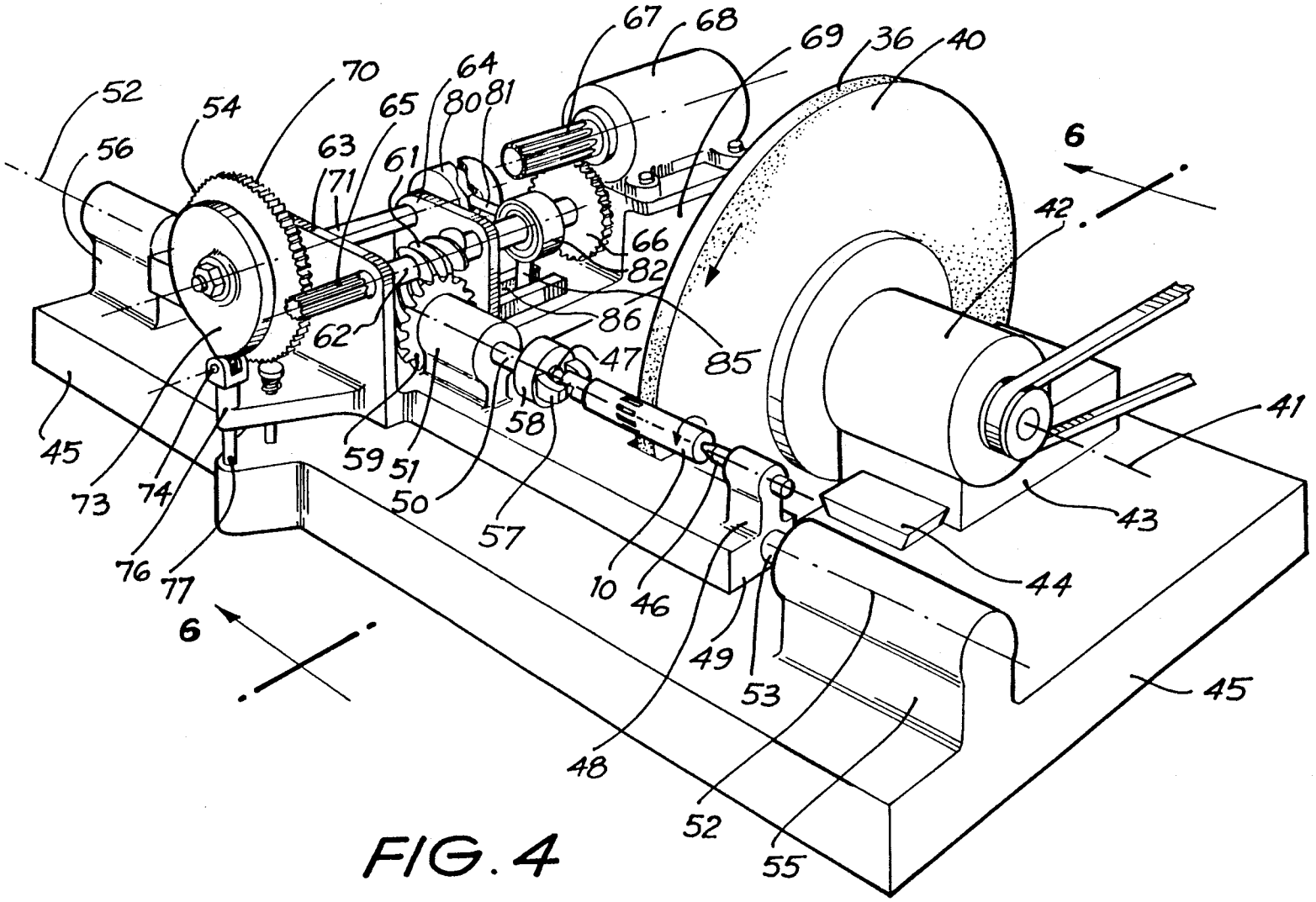
Figure 5:
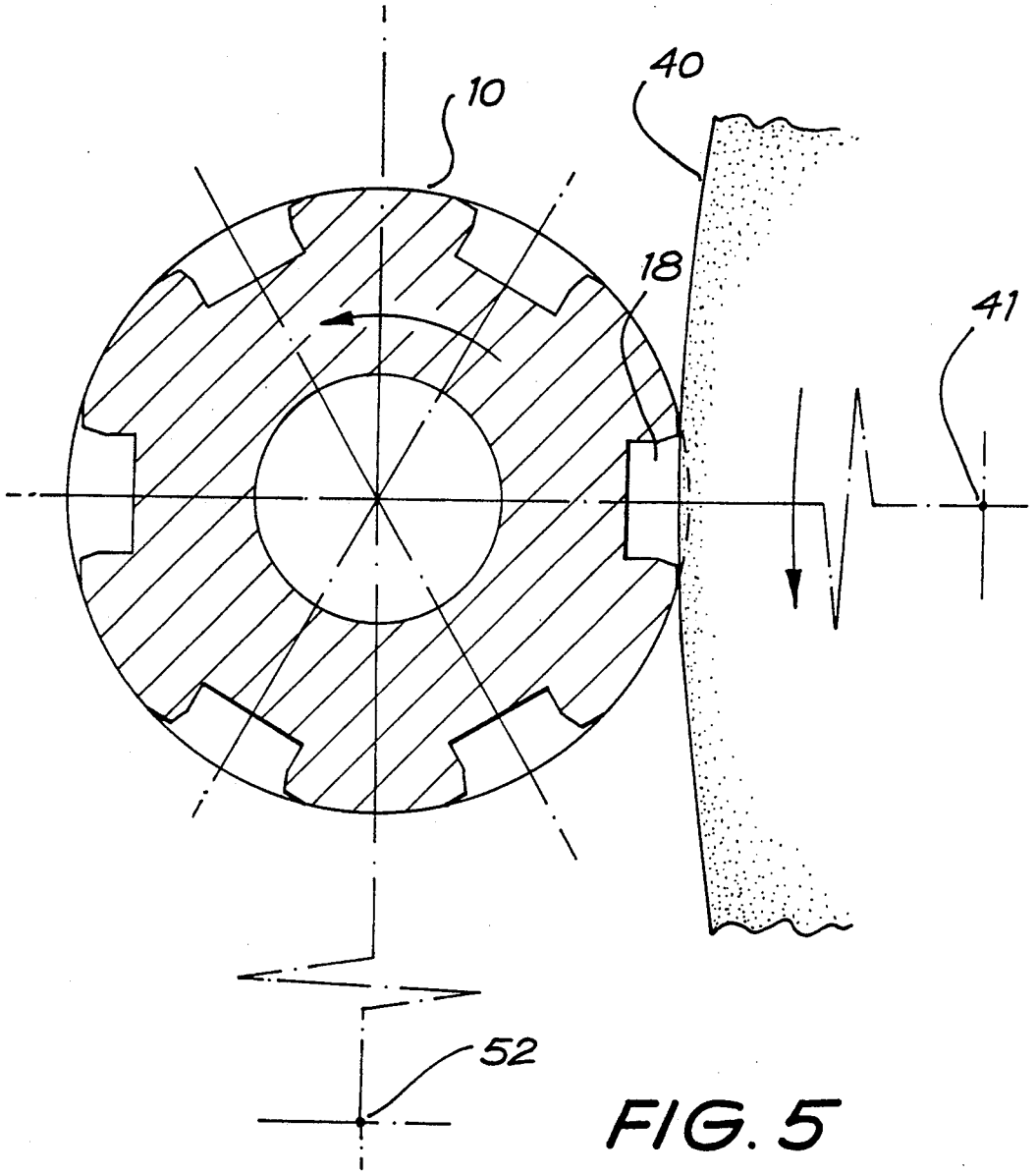
Figure 6:
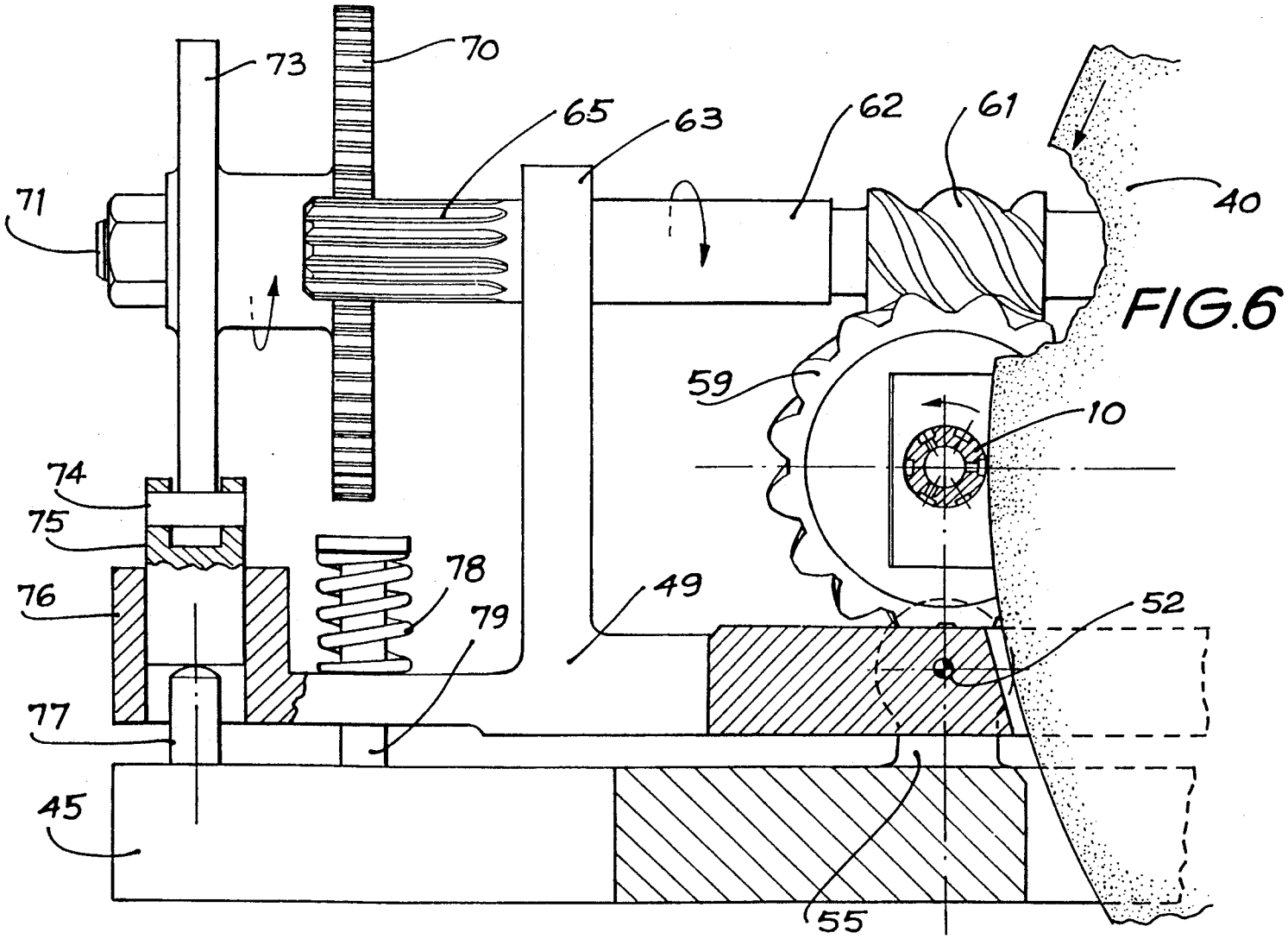
Figure 8:
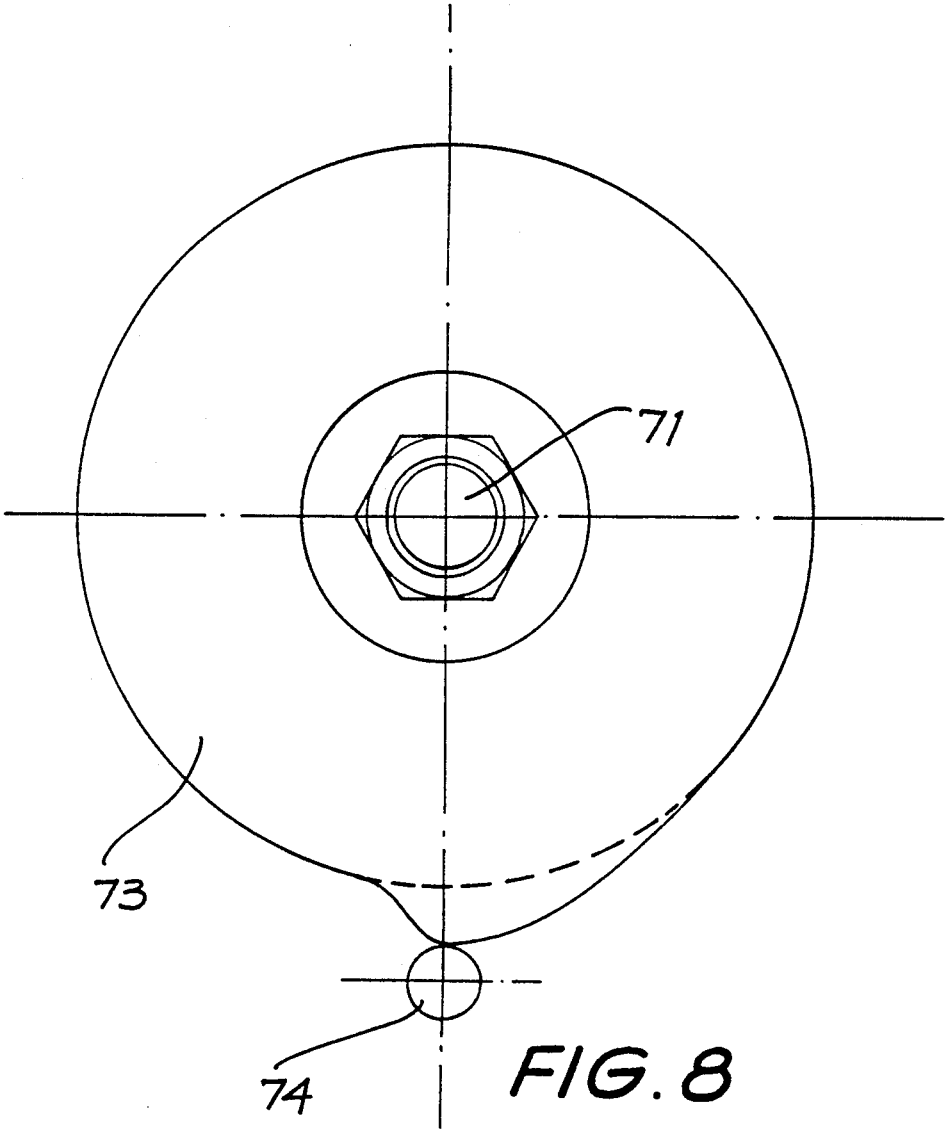
Figure 9:
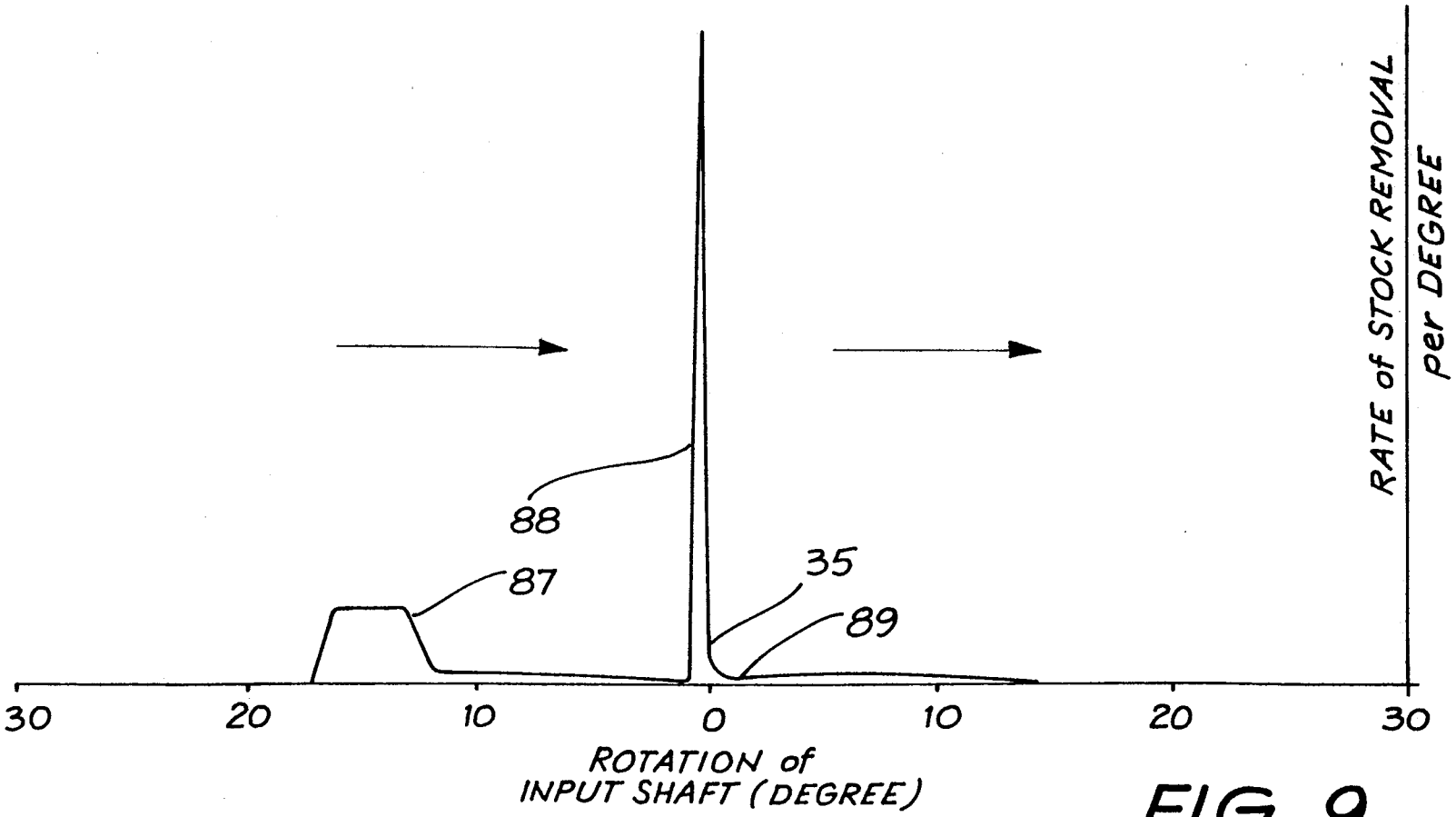

In order that the invention may be better understood, a preferred form thereof is now described, by way of example, with to the accompanying drawings, in which:

FIG. 1 is a cross-sectional view of a rotary valve installed in a valve housing of a power steering gear, FIG. 2 is a cross-sectional view on plane AA in FIG. 1 of the input-shaft and surrounding sleeve components of the rotary valve, FIG. 3 is a greatly enlarged view of region B in FIG. 2 showing details of the orifice formed between the input-shaft metering edge contour and the adjacent sleeve slot edge, FIG. 4 is a perspective view of a metering edge contour grinding machine according to the present invention, FIG. 5 is a cross-sectional view on plane CC in FIG. 4 showing the grinding wheel in contact with the input-shaft, FIG. 6 is a cross-sectional view on plane CC in FIG. 4 showing details of the drive to the rocking platform, FIG. 7 is a magnified view of a portion of the machine in FIG. 4 showing details of the barrel cam, FIG. 8 is a view of cam 73 normal to its axis, and FIG. 9 is a plot of the rate of stock removal as a function of input-shaft rotation angle for the grinding of the two metering edge contours on a given groove (ie, the plot corresponds to 60 degrees input-shaft rotation angle).

Referring to FIG. 1, valve housing 1 is provided with pump inlet and return connections 2 and 3 respectively and right and left hand cylinder connections 4 and 5. Steering gear housing 6, to which valve housing 1 is attached, contains the mechanical steering elements, for example, pinion 7, journalled by ball race 8 and provided with seal 9. The three main valve elements comprise input-shaft 10, sleeve 11 journalled thereon, and torsion bar 12. Torsion bar 12 is secured by pin 13 to input-shaft 10 at one end, similarly by pin 14 to pinion 7 at the other. It also provides a journal for input-shaft 10 by way of bush 15. Sleeve 11 has an annular extension having therein slot 16 engaging pin 17 extending radially from pinion 7.

Referring now also to FIG. 2, input-shaft 10 incorporates on its outside periphery six axially extending, blind-ended grooves 18. These grooves are disposed in an underlap relationship to six corresponding axially extending, blind-ended slots 19 on the mating inside diameter of sleeve 11. Sleeve 11 is also provided on its outside periphery with a series of axially spaced circumferential grooves 20*a*, 20*b*, 20*c* separated by seals. Radial holes 21 in input-shaft 10 connect alternate grooves 18 to center hole 22 in input-shaft 10 whence return oil can flow to pump return connection 3.

Radial holes 23 in sleeve 11 connect the remaining alternate grooves 18 of input-shaft 10 to the center circumferential groove 20*b*, and so to inlet port 2. Alternate sleeve slots 19 are connected by radial holes 24 to corresponding circumferential grooves 20*a* and 20*c* and so to cylinder connections 4 and 5.

In FIG. 2 it will be seen that, in the centred position of the valve illustrated, the underlapping of the six grooves 18 and six slots 19 form twelve axially extending orifices 25, whose area varies as a function of valve operating angle, that is as a function of the relative rotation of input-shaft 10 and sleeve 11 from their centred position.

FIG. 3 is a greatly enlarged view of region B in FIG. 2 showing details of one such orifice 25 formed between the metering edge contour 26 of one groove 18 of input-shaft 10, and the interacting adjacent edge 27 of one slot 19 of sleeve 11. In the rotary valve described in this embodiment, all twelve metering edge contours 26 are of identical geometry, with alternate metering edge contours a mirror image of that shown. Metering edge contour 26 is shown here in its orientation with respect to edge 27 when the valve is in the centred position. As relative rotation occurs between input-shaft 10 and sleeve 11, edge 27 moves successively to positions 27*a*, 27*b* and 27*c*, these rotations from the centred position corresponding to valve operating angles 28*a*, 28*b* and 28*c* respectively. Metering edge contour 26, termed the outer metering edge contour, extends from the junction with the outside diameter 29 of input-shaft 10 as at point 30, to the junction with the inner metering edge contour 31 as at points 32 and 33.

The portion of outer metering edge contour 26 between points 30 and 34 is essentially a flat chamfer, after which it becomes increasingly convex as it approaches point 32. Here it has become perpendicular to centerline 35 of groove 18, and hence can no longer be further ground by a large diameter grinding wheel whose periphery, at the scale shown here, appears as near-straight line 36. Outer metering edge contour 26 has a spiral or scroll like geometry between points 34 and 32, assisting to provide the linear pressure characteristic required of such valves.

Inner metering edge contour 31 is shown as two lines representing the curved nature of the sides of groove 18, which may be so formed by milling, hobbing or roll-imprinting methods well known in the art. Prior to grinding the outer metering edge contour 26, inner metering edge contour 31 would have extended to intersect the input-shaft outside diameter 29 along a curved line on this diameter between points 37 and 38.

It can be appreciated that the pressure rise developed by orifice 25, up to valve operating angle 28*a* where (at point 27*a*) sleeve slot edge 27 makes its closest approach to point 32, is controlled by the form of the inner metering edge contour 31. On the other hand, the pressure rise developed by orifice 25 through the range of valve operating angles 28*a*–28*c* is controlled exclusively by the form of the outer metering edge contour 26. At point 39 the depth of the outer metering edge contour 26, that is distance 27*c*–39, is typically 0.012 mm and generates sufficient pressure for vehicle parking.

FIG. 4 shows schematically the principal features of a metering edge contour grinding machine in which large diameter grinding wheel 40 is mounted on a spindle having an axis 41 housed in journal 42 carried on slide 43 operable in slideway 44 which forms part of machine base 45. Input-shaft 10 is supported for rotation on dead center 46 and live center 47. Dead center 46 is mounted via pedestal 48 to rocking platform 49. Live center 47 protrudes from main work spindle 50, journalled for rotation in pedestal 51, and also mounted to rocking platform 49. Rocking platform 49 is journalled for oscillation about axis 52 via pivots 53 and 54, respectively carried in pedestals 55 and 56 extending from machine base 45.

This geometry is more clearly shown in FIG. 5 which shows grinding wheel 40 at the instant of grinding the two regions between points 32 and 33 (in FIG. 3) of outer metering edge contour 26 on opposing edges of grooves 18 of input-shaft 10. Input-shaft 10 is rotating in the direction shown about the axis defined by dead center 46 and live center 47 and, according to normal cylindrical grinding practice, grinding wheel 40 is rotating in the same direction about axis 41. Oscillation of rocking platform 49 occurs about axis 52 through a small angle causing input-shaft 10 to infeed and outfeed from grinding wheel 40, and hence grind outer metering edge contours 26.

Input-shaft 10 incorporates two flats 57 machined thereon which are gripped by the two floating jaws of chuck 58, surrounding live center 47 and also driven by main work spindle 50. The manner of opening and closing the jaws of chuck 58 is conventional. Main work spindle 50 is journalled in pedestal 51 which forms part of rocking platform 49 and is rotated by worm wheel 59 secured thereon. Worm 61, integral with worm shaft 62, engages worm wheel 59 in a slack free manner and is journalled for both rotation and axial sliding in journal plates 63 and 64 extending vertically from rocking platform 49. Worm shaft 62 extends forwardly of journal plate 63 (in FIG. 4) and has pinion teeth 65 cut thereon, and extends rearwardly of journal plate 64 to support gear 66 which engages pinion 67 of motor 68. Motor 68 is mounted on bracket 69 which forms an integral part of rocking platform 49 and therefore oscillates therewith about pivots 53 and 54. Note that pinions 65 and 67 are both elongated to allow meshing with gears 70 and 66 respectively as worm shaft 62 slides axially in its journals. This axial sliding of worm shaft 62 is therefore capable of adding or subtracting small incremental angular rotations to (or from) the overall angular rotation of main work spindle 50.

Gear 70 is carried on shaft 71, also journalled for rotation in journal plates 63 and 64, but restrained from axial sliding therein. The ratios of pinion teeth 65, gear 70, worm 61 and worm wheel 59 are such that when grinding a six groove input-shaft, shaft 71 makes six revolutions for one revolution of main work spindle 50. Referring now also to FIG. 6, cam 73 is mounted on shaft 71 and contacts follower pin 74 journalled in slider 75, slider 75 in turn housed within boss 76 extending from rocking platform 49. At its lower end slider 75 rests on pin 77 secured to machine base 45. Spring 78, loaded against rocking platform 49 by headed pin 79, keeps cam 73 in contact with follower pin 74 and slider 75 in contact with pin 77, and assures a positive, slack-free oscillation of rocking platform 49 in accordance with the lobed profile of cam 73. This oscillation of rocking platform 49 serves to sequentially infeed and outfeed input-shaft 10 from grinding wheel 40, thereby grinding outer metering edge contours 26. As seen in FIG. 7, axial sliding of worm shaft 62 is controlled by barrel cam 80 having therein an endless spiral track shown which is engaged by pin 81 protruding from collar 82 journalled on worm shaft 62, but axially restrained thereto by shoulders 84. It is prevented from rotating by having guide pin 85 extending downwardly into slot 86 in rocking platform 49.

Upon starting motor 68, main work spindle 50 and input-shaft 10 commence to rotate in the direction shown and slide 43 immediately feeds in a small amount in order to commence grinding input-shaft 10. The width of grinding wheel 40 is such as to grind the entire axial length of metering edge contour 26. As rotation of input-shaft 10 continues, rocking platform 49 moves about pivots 53 and 54 under the action of cam 73 until the position shown in FIGS. 5, 6, 7 and 8 is reached, that is, input-shaft 10 and grinding wheel 40 respectively reach their closest point after which the direction of movement of rocking platform 49 reverses. One sixth of a revolution of input-shaft 10 later, the sequence is repeated as the outer metering edge contour 26 of the next groove 18 are ground.

It will be seen in FIG. 8 that, at the instant shown, follower pin 74 has reached the peak of the profile on cam 73 plunging input-shaft 10 into grinding wheel 40, whereas a relatively smooth contour exists on the remainder of cam 73.

The more severe rocking motion of rocking platform 49 at this point is needed to produce the flat surface 32–33 which is co-planar with that portion of the metering edge contour on the opposite side of the groove 18 (refer to FIG. 3). At this single instant, most of the necessary metal stock on both edges of groove 18 has been removed due to the bridging effect of the large diameter of grinding wheel 40 as compared to that of input-shaft 10.

FIG. 9 shows a diagram of the rate of stock removal during rotation of the input-shaft from 30 degrees before the centerline 35 of groove 18 to 30 degrees after. This indicates that, as grinding proceeds in the direction indicated, that is from left to right in FIG. 3, most of the stock is removed suddenly as indicated as event 87 corresponding to grinding outer metering edge contour 26 between points 30 and 34 in FIG. 3. Thereafter, as rotation continues, there is little removal of stock as grinding continues between points 34 and 32. In the last instant, however, the input-shaft is thrust towards the grinding wheel resulting in the enormous rate of stock removal shown as event 88. On reaching centerline 35 of groove 18, instantly the rate of stock removal decreases to a low level as shown by event 89. Thereafter only a slight amount of stock is removed. This great change of rate of stock removal is quite unacceptable in precision grinding practice and therefore the angular velocity of input-shaft 10 must be varied over a wide range slowing down as event 87 occurs and virtually stopping at event 88. This is accomplished by the thrusting of worm 61 axially as it rotates in mesh with worm wheel 59 through the action of the spiral track in barrel cam 80 engaging pin 81 as shown in FIG. 7.

It is important to note that the entire event is grossly asymmetric about centerline 35 of groove 18 in terms of rotation angle of input-shaft 10. Events such as 88, which correspond to periods of high stock removal rate during very small rotational angles of input-shaft 10 are considerably magnified in angle on cam 73 due to the programmed instantaneous very high velocity ratio between cam 73 and input-shaft 10. The nature of the variation of this velocity ratio is a function of the form of the spiral track in barrel cam 80. The nature of the variation of the stock removal rate (as a function of time) is therefore a function of both this form and also the form of the profile on cam 73. Therefore at least one of these two forms is necessarily asymmetric to counteract the asymmetric variation of the stock removal rate as a function of input-shaft rotation angle. Ideally both these forms will be asymmetric, as shown in this embodiment, in order to limit the gradients of the cam profiles to practical values consistent with normal machine practice.

Irrespective of the details of the cam profiles, the net effect is that of providing for a large variation in the angular velocity of the input-shaft during grinding to "even-up" (or make more uniform) the grinding pressure between the grinding wheel and the input-shaft, hence avoiding gouging of the grinding wheel as would otherwise occur, and at the same time allow the mean effective rotational speed of the machine to be 20 to 30 times as great as would occur if the rotational speed were constant and thus limited by the aforementioned peak stock removal rate.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. A machine for grinding the outer metering edge contours on the edges of the axially extending grooves of a power steering gear input-shaft, having means for supporting said input shaft for rotation, a substantially cylindrical grinding wheel whose working surface is dressed parallel to the axis of said input-shaft, drive means to rotate said input-shaft, means to cyclically increase and decrease the distance between said input-shaft and said grinding wheel several times during each revolution of said input-shaft in such a manner that each said outer metering edge contour so ground has a form which is a mirror image of the form of at least one other outer metering edge contour around the outside periphery of said input-shaft, so defining symmetrical sets of clockwise and anticlockwise metering edge contours, characterized in that said drive means is arranged to vary cyclically the angular velocity of said input-shaft in a manner co-ordinated with said cyclic increase and decrease of said distance between said input-shaft and said grinding wheel, thereby substantially reducing the peak rate of stock removal per unit time compared with the peak rate that would occur if said angular velocity were constant and equal to the mean value of said cyclically varying angular velocity.

2. A machine as claimed in claim 1 in which said drive means is constructed and arranged so that said variation of the angular velocity of said input-shaft when said distance is decreasing as when grinding the first outer metering edge contour of any one of said sets, is different from said variation of the angular velocity of said input-shaft when said distance is increasing as when grinding a second symmetrical outer metering edge contour of said set.

3. A machine as claimed in claim 1 wherein said drive means is constructed and arranged so that the rate of said increase and decrease of said distance varies with respect to said angular velocity of said input-shaft during the grinding of each outer metering edge contour so as to provide a substantially scroll-like metering edge contour having a substantially flat chamfer adjacent to the cylindrical outside diameter of said input-shaft and a scroll of progressively reducing radius towards the respective groove edge.

4. A machine as claimed in claim 1, in which the means for supporting said input-shaft for rotation is mounted on a cradle journalled for rocking motion about an axis parallel to said axis of said input-shaft and displaced therefrom, said rocking motion effecting said cyclic increase and decrease in said distance between said input-shaft and said grinding wheel several times during each revolution of said input-shaft, a motor driving a main drive means, a first cam arranged for rotation on a shaft driven from said main drive means, a first follower means engaging said first cam and operatively connected to said cradle so as to impart said rocking motion thereto, a second cam arranged for rotation on a shaft also driven from said main drive means, a second follower means engaging said second cam, a differential device arranged between said main drive means and said input-shaft to effect rotation of said input-shaft, said differential device having a first input operatively connected to said main drive means and an output operatively connected to said input-shaft, said differential device being arranged to have a second input operatively connected to said second follower means thereby effecting said cyclic variation of said angular velocity of said input-shaft several times during each revolution thereof.

* * * * *